United States Patent [19]

Southard et al.

[11] 4,202,239

[45] May 13, 1980

[54] TONE GENERATOR KEYER CONTROL SYSTEM

[75] Inventors: James S. Southard, Union; Daniel R. Mott, Dowagiac, both of Mich.

[73] Assignee: C. G. Conn, Ltd., Oak Brook, Ill.

[21] Appl. No.: 867,908

[22] Filed: Jan. 9, 1978

[51] Int. Cl.[2] ..... G10H 1/02; G10H 5/00

[52] U.S. Cl. ..... 84/1.26; 84/1.13; 84/DIG. 2

[58] Field of Search ..... 84/1.01, 1.03, 1.13, 84/1.26, DIG. 2

[56] References Cited

U.S. PATENT DOCUMENTS

| | | | |
|---|---|---|---|
| 3,519,723 | 7/1970 | Wiest | 84/1.26 |
| 3,610,806 | 10/1971 | Deutsch | 84/1.26 |
| 4,079,650 | 3/1978 | Deutsch et al. | 84/1.26 |
| 4,085,643 | 4/1978 | Griffith | 84/1.01 |

*Primary Examiner*—S. J. Witkowski
*Attorney, Agent, or Firm*—Kenyon & Kenyon

[57] ABSTRACT

A limited number of top octave synthesizer tone generating circuits for producing various tones are used in an electronic organ. Each of the top octave synthesizer circuits is capable of producing any tone which can be produced by the organ. An assignment circuit is employed to assign different ones of the top octave synthesizers to produce the tones represented by different key closures. Because of the limited number of tone generator circuits employed, it is possible under some circumstances to attempt to cause the organ system to produce root tone outputs in excess of the number of top octave synthesizer circuits used in the system. When this occurs, a root tone for a new note is assigned to the top octave synthesizer circuit which is farthest into its decay mode of operation, thereby terminating the tone previously produced by that top octave synthesizer circuit earlier than would be the case if the full decay of that tone were permitted to take place. Both digital and analog systems are disclosed for accomplishing this result.

8 Claims, 5 Drawing Figures

TONE GENERATOR KEYER CONTROL SYSTEM

RELATED PATENT AND APPLICATIONS

U.S. Pat. No. 3,955,460, issued May 11, 1976, directed to a digital multiplex electronic musical instrument and co-pending applications Ser. No. 834,245, filed Sept. 19, 1977, and now abandoned. Ser. No. 867,907, filed Jan. 9, 1978, all assigned to the same assignee as this application, are related to the subject matter of this application.

BACKGROUND OF THE INVENTION

This invention is broadly related to the field of electronic musical instruments, particularly electronic organs or other electronic musical instruments having a keyboard such as electronic pianos, accordions and the like. The term "organ" as used throughout the specification and claims is intended in a generic sense to include these other electronic musical instruments. In addition, reference to the actuation of key switches or coupler switches and the like is intended to cover the actuation of such switches by whatever means may be employed, such as directly by action of the musician's fingers or indirectly through intervening levers, apertures, switch closings, touch responsive switches, multiplex circuits, etc.

In the design of typical electronic organs today, a system known as a top octave frequency synthesizer system (TOS) has been developed which overcomes the need for using a large number of expensive stable oscillators in the organ. Instead, a single stable oscillator is used to provide the tones for the top octave of the organ. Divider circuitry then is employed to generate all of the other related tones, and tuning of such an organ becomes a relatively simple matter since only a single oscillator or a small number of oscillators are used in the organ.

While top octave synthesizer systems theoretically can use a single oscillator for an entire organ this has not proved to be practical. One disadvantage of employing a top octave synthesizer is that because of the close interrelationship of all of the divided-down frequencies it is possible to obtain phase reinforcement or phase cancellation of harmonics of different tones, which results in very unnatural quality musical production by the organ. To overcome these disadvantages, a number of different top octave synthesizers have been utilized in an organ; so that different notes for different octaves in the different manuals of the keyboard are produced by different top octave synthesizers. If such synthesizers are dedicated to a particular block of keys or a particular part of the organ, however, it still is necessary to use a relatively large number of synthesizer circuits in the organ.

In the system disclosed in the co-pending patent application Ser. No. 867,907, a limited number of different top octave synthesizer circuits are used, each of which is capable of producing any note in the organ. The assignment of different root notes to these different top octave synthesizer circuits is effected under control of a latch signal synchronized with the serial digital data representative of key closures used in the multiplex system with which the synthesizer circuits are used. In such a system, where the number of different top octave synthesizer circuits are less than, equal to or only slightly more than the maximum number of root notes which normally are played by the organ, the assignment of a previously unassigned top octave synthesizer circuit ordinarily can be controlled by a suitable logic circuit which senses whenever a particular top octave synthesizer circuit is idle, waiting for a new note to be assigned to it. The determination of whether or not a synthesizer is idle cannot be ascertained merely by sensing the key closures associated with the initiation and termination of the note produced by any given top octave synthesizer. This is because there generally is a decay of the produced tone which extends the tone in attenuated fashion (with increasing attenuation) after release of the key, the closure of which initially produced that tone.

Because this characteristic of permitting a top octave synthesizer to continue to produce a tone in an increasingly attenuated fashion after release of the key which initiated that tone, it is possible in some circumstances, to create a demand for more root tones in the system than there are empty or wholly unassigned top octave synthesizer systems available to produce the tones demanded. Of course, one solution is to provide a number of top octave synthesizers which is greater than the maximum number of tones which could be produced at any time in the organ whether the tone production results from the actual playing of a key or the decaying tonal characteristics after a key is released. This approach, however, is wasteful of synthesizer circuits and substantially increases the cost and complexity of the circuitry in the organ, and its ultimate price to the customer purchasing such an organ.

To minimize the number of top octave synthesizer circuits needed and to continue to permit the organ to produce the most natural sounding musical characteristics, it is desirable to reassign a top octave synthesizer circuit to a new note only if such a top octave synthesizer is (1) operating on the decay tonal characteristics of a note indicating that its actual playing has been terminated and (2) if such a top octave synthesizer circuit is the one in the system which is the farthest into its decay, that is, the one with the most highly attenuated tone output.

SUMMARY OF THE INVENTION

Accordingly, it is an object of this invention to provide an improved electronic musical instrument.

It is another object of this invention to provide an improved tone generation assignment system for an electronic musical instrument.

It is an additional object of this invention to provide an improved tone generation assignment circuit for an electronic organ utilizing a minimum number of top octave synthesizer tone generator circuits.

It is a further object of this invention to provide an electronic organ using top octave synthesizer circuits with a control system for assigning notes to be reproduced by the organ to top octave synthesizer tone generator circuits in an order corresponding to which of the top octave synthesizer circuits is farthest into its attenuated decay mode of operation.

It is still another object of this invention to provide an electronic organ utilizing a limited number of top octave synthesizer tone generator circuits with an assignment control system which assigns the next new note to the synthesizer circuit which is the farthest into its decay or attenuated mode of operation when the number of root notes to be produced exceeds the number of synthesizer circuits.

In accordance with a preferred embodiment of the invention, a keyer control system is used in an electronic musical instrument which has a fixed plurality of tone generators each capable of producing tones in the same octaves of tones which can be played by the instrument. Input signals which are representative of different tones to be produced by the system are coupled to all of the various tone generators, and an assignment circuit is also coupled to the tone generators to enable different ones of them in a pre-established sequence to produce tones which are represented by the input signals, each of the tone generators thereby producing a different tone according to the input signal applied to it. Each of the tone generators has a different keyer pedestal circuit connected to it to control the sustain and decay characteristics of the tones produced by the tone generator; and whenever the number of input signals for different tones to be produced by the system exceeds the number of tone generators, a circuit responds to cause the assignment circuit to assign each of the new excess tone input signals, representative of new notes, to the tone generator farthest into its decay mode of operation.

DETAILED DESCRIPTION OF THE PREFERRED EMBODIMENT

Figure 1A:
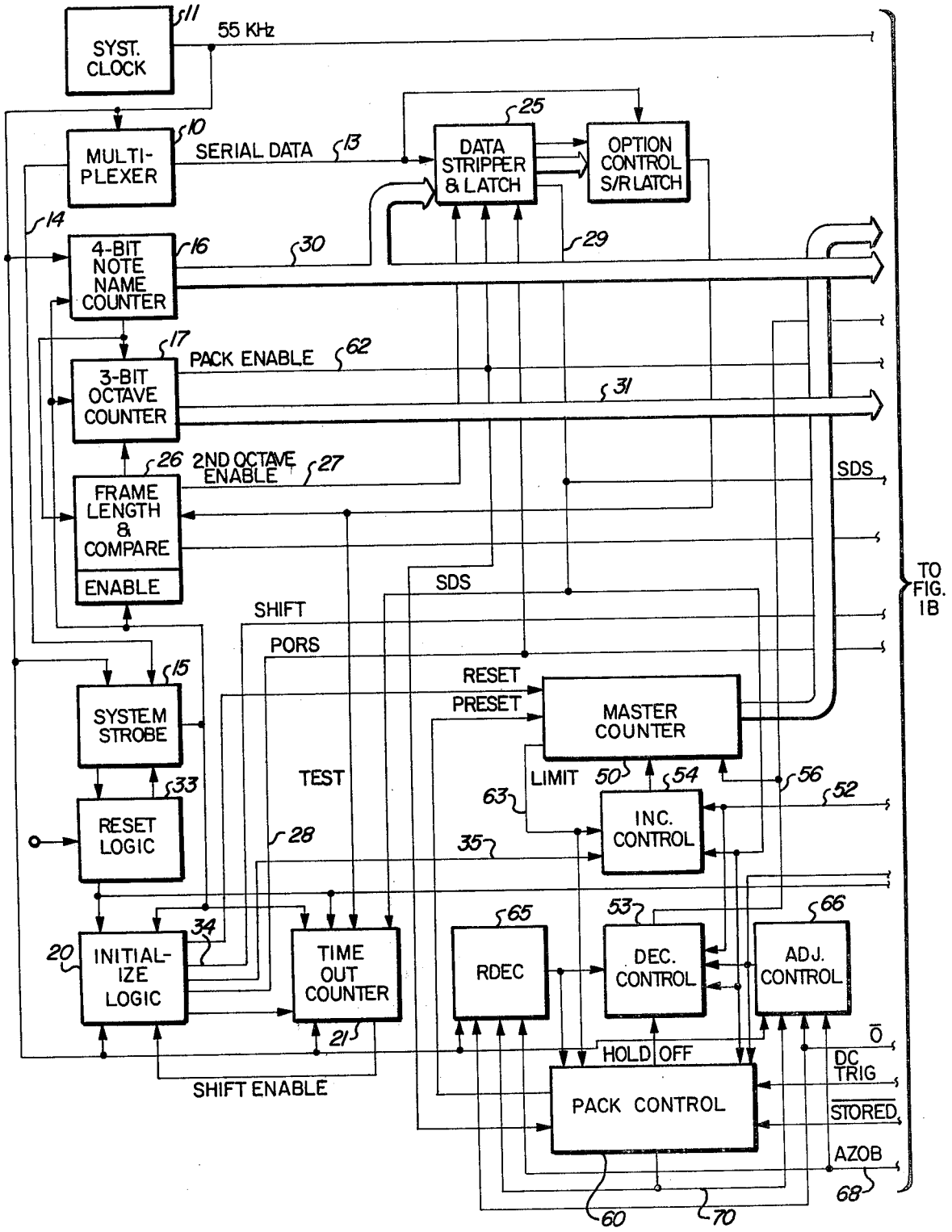
FIGS. 1A and 1B are a block diagram of a preferred embodiment of the invention.

In the drawings, the same or similar reference numerals are used throughout the several figures to designate the same or similar components.

Figure 1B:
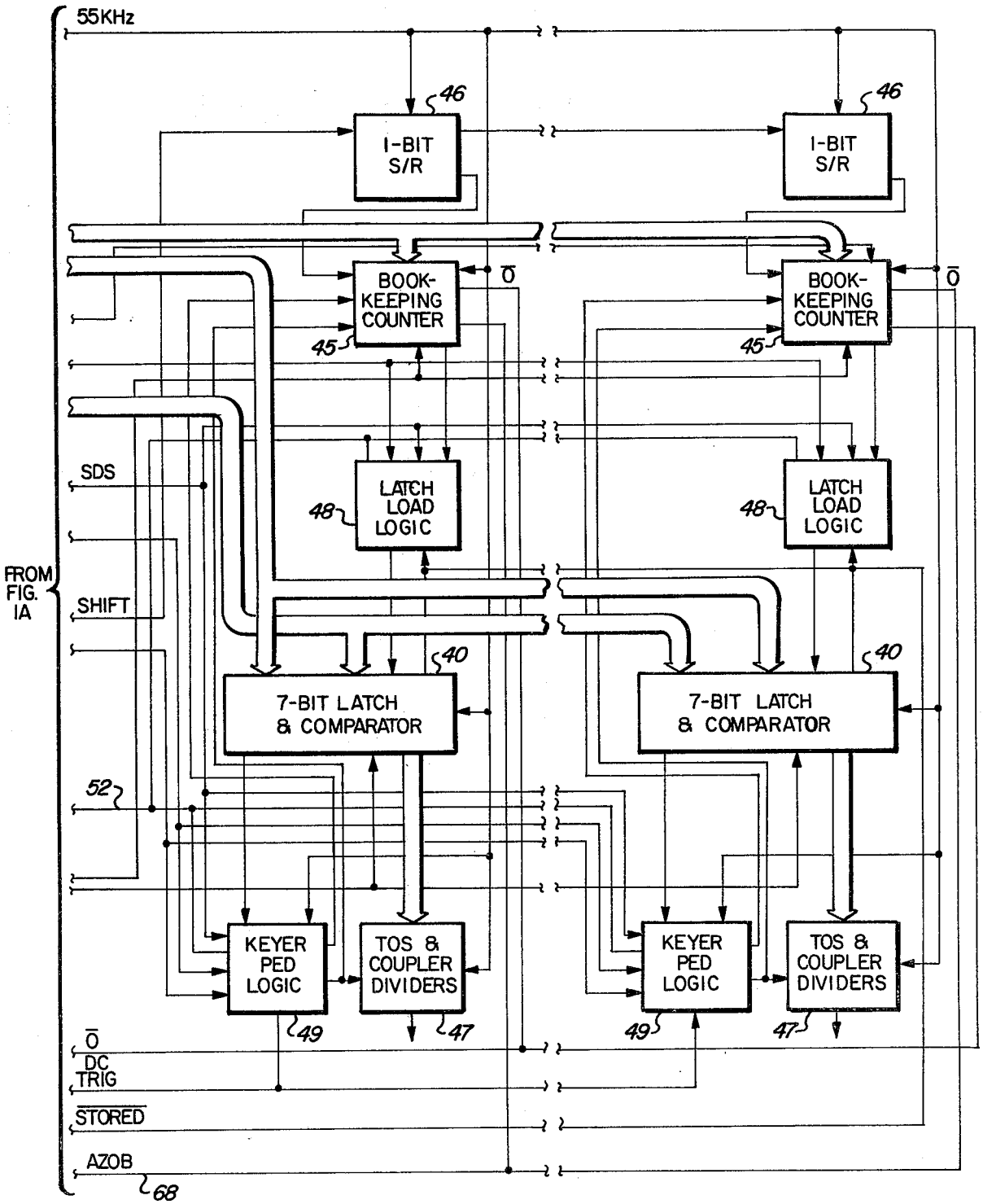
Figure 1C:
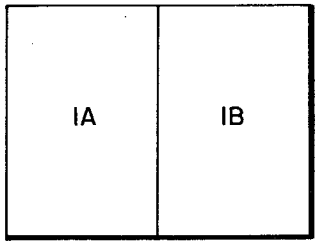
FIG. 1C shows the manner in which the sheets of FIGS. 1A and 1B bit together.

Referring now to FIGS. 1A–1C, there is shown a keyer control system for use in an electronic musical instrument, such as an electronic organ of the type using serial multiplex data generation as disclosed in the above-mentioned U.S. Pat. No. 3,955,460, the disclosure of which is incorporated herein by reference. In the digital multiplex electronic organ disclosed in that patent, a multiplexer circuit controlled by a system clock operates to present the serial data, representative of key closures and the operation of coupler switches, in the form of a serial data signal train which has a fixed number of time slots in it and which is continuously repeated cyclically in the operation of the system. Such a multiplexer 10 and a system clock 11 for providing the timing and clock pulses to the multiplexer circuit 10 are illustrated in FIG. 1A. The multiplexer 10 and the system clock 11 are operated in the same manner as described in the above mentioned patent and are the source of the key closure and coupler switch information which is utilized in the system of the embodiment shown in FIGS. 1A and 1B to operate various top octave synthesizer circuits to produce the tones which are represented by the binary data in the serial data output from the multiplexer 10 as it is applied over an output lead 13.

In the system shown in FIGS. 1A and 1B, a limited number of top octave synthesizer circuits are used to generate the various notes of the organ. Typically, the organ includes twelve such top octave synthesizers, but it may include only as few as six depending, upon the desired characteristics of the organ performance. Each of the different top octave synthesizer sections of the organ may be assigned to any one of the keyboard multiplexer serial data time slots which represent a key closure, so that the selection circuitry not only determines which top octave synthesizer is selected, but also is operated in synchronism with the serial multiplexed data appearing on the lead 13 to cause the proper root note to be produced by the selected top octave synthesizer. At different times, different notes are assigned to the different top octave synthesizers to permit the maximum flexibility and efficiency in the operation of the system, as will be more fully understood from the following description.

At the beginning of each frame or new cycle of serial data produced by the multiplexer 10 on the lead 13, a strobe or frame pulse is applied over a lead 14 to operate as a system strobe or system reset pulse through a gating system strobe circuit 15. This strobe pulse is synchronized with the clock pulses produced by the clock 11 and applied from the clock 11 over another lead to the system strobe circuit 15. The output of the system strobe circuit 15 is utilized as a reset pulse to reset a four-bit note-name counter 16 and a three-bit octave counter 17 to an initial or zero count. In addition, this strobe pulse is applied to an initialize logic circuit 20 and to a time-out counter 21 to reset both of these circuits to an initial operating condition.

The four-bit note-name counter 16 and the three-bit octave counter 17 thus are initially set up for operation and synchronism with the serial multiplexed data appearing on the lead 13. The note-name counter 16 is advanced by the clock pulses produced at the output of the system clock 11 (which also synchronizes the operation of the multiplexer 10), so that the step-by-step advancement of the note-name counter 16 is in synchronism with the binary serial data appearing on the lead 13. As described in the above mentioned patent, this data has the different time slots in it sequentially assigned on a note-by-note basis for successive octaves; so that the count in the note-name counter 16 corresponds to this note-by-note progression. Each time a count of twelve (the number of notes in an octave) is reached, an output pulse is produced by the note-name counter 16 to advance the three-bit octave counter 17 to its next count. This operation continues through all of the counts for the number of octaves of information represented in each cycle of the serial data produced on the lead 13 by the multiplexer circuit 10.

As described in the aforementioned patent, the first portion of the serial data stream produced by the multiplexer circuit constitutes the stop and coupler information. This portion of data is stripped from or blanked from the serial data stream used in the TOS assignment circuit of FIGS. 1A and 1B by a data stripper and latch circuit 25. This circuit is reset to an initial or blanking condition by the initialize logic 20 when the power is first applied to the system by a pulse (PORS) over a lead 28. In addition, a frame length and comparison circuit 26 is controlled by the octave count output of the note-name counter 16 to produce an enable pulse after two octaves of serial data information have been counted. The enable pulse is applied over a lead 27 to the data stripper and latch circuit 25 to terminate the data stripping action and to permit the serial data appearing on the lead 13 to pass through the circuit 25 over a lead 29 to the other portions of the circuit for use in the operation of the system. It should be noted that the frame length and compare circuit 26 is enabled for operation by the system strobe pulse obtained from the output of the system strobe circuit 15 each time a strobe pulse is applied to it by the multiplexer 10. Such strobe pulses occur cyclically, once per frame, in the serial multiplex data stream produced by the multiplexer 10.

The parallel four-bit output from the note-name counter 16 is applied over a set of four output leads 30 to the data stripper and latch circuit 25 and to a series of seven-bit latch and comparator circuits 40, a different one of which is associated with each different top octave synthesizer circuit used in the system. Similarly, the parallel three-bit output from the octave counter 17 is applied over three parallel output leads 31 to the seven-bit latch and comparator circuits 40, so that these circuits are provided with the necessary note name and octave information required for decoding root notes in any octave which can be keyed in the system by the appropriate top octave synthesizer circuits controlled by the latch and comparator circuit. This latch and comparator circuit is the same as the latch and comparator circuits 13 and 14 of the co-pending application Ser. No. 867,907.

Figure 2:
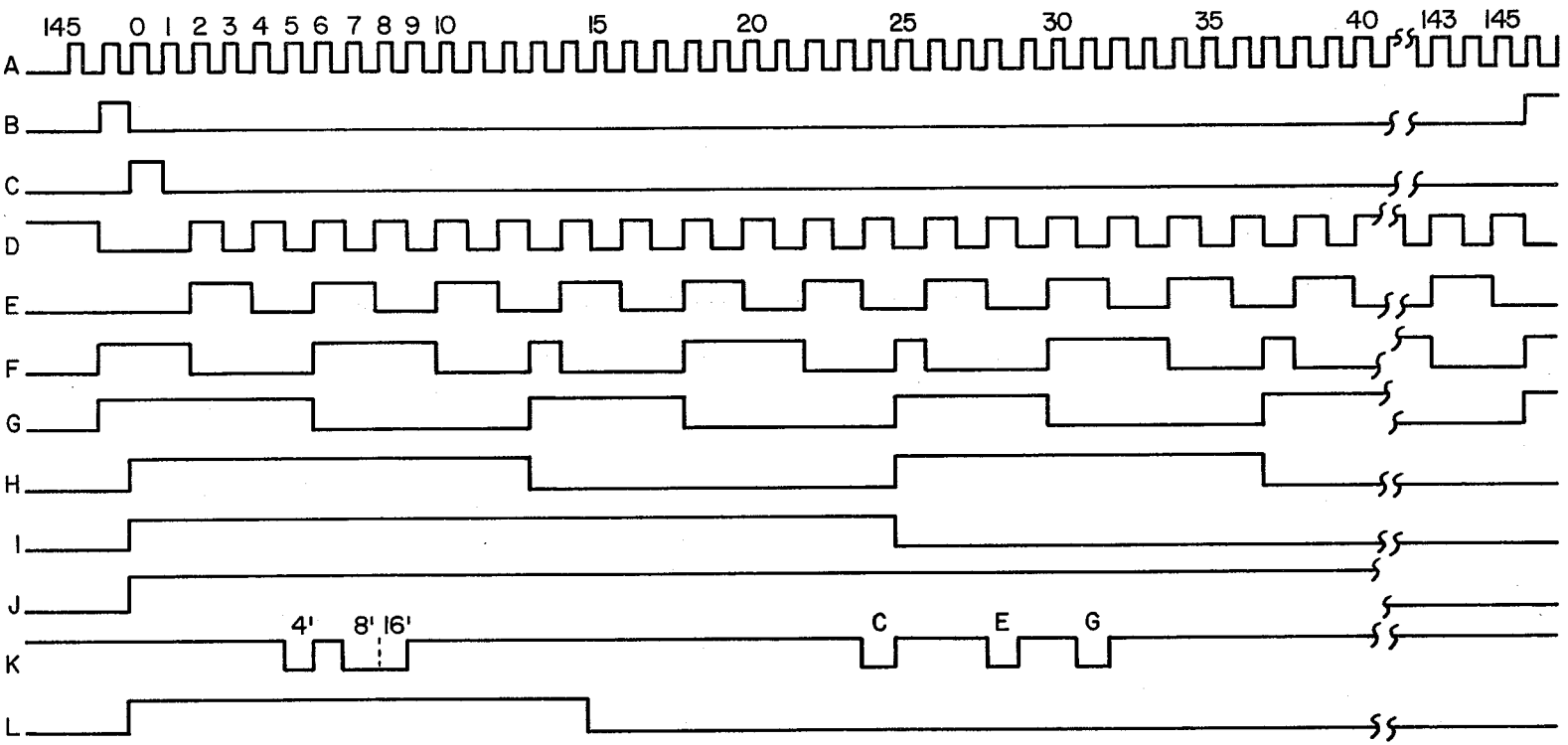
FIG. 2 is a series of waveforms useful in explaining the operation of the circuit of FIGS. 1A and 1B.

Reference now should be made to FIG. 2 which illustrates the basic timing of the system clock and correlates that timing with the signals from the output of the multiplexer 10, the note counter 16, the octave counter 17, and the data stripper and latch circuit 25. Waveform A of FIG. 2 represents the 55 kHz clock signals produced by the system clock 11 and utilized to operate the remainder of the system. Waveform B represents the strobe pulse which is obtained on the output lead 14 from the multiplexer circuit 10, and waveform C comprises the internal system strobe pulse produced on the output of the system strobe circuit 15.

Waveforms D, E, F and G are representative of the parallel four-bit output from the note-name counter 16. From an examination of FIG. 2 it can be seen that this sequence resets and repeats itself every twelve pulses in the output waveform A of the system clock 11. For example, pulse number 1 comprises the first clock pulse associated with the first "note" of the first octave in the system and pulse number 13 comprises the first pulse of the first "note" of the second octave in the system, and so on.

Waveforms H, I and J represent the parallel three-bit output of the octave counter 17 which is reset by the strobe pulse to its initial count at the beginning of each frame of the serial multiplex data produced by the multiplexer 10. Waveform K is representative of a typical frame of serial data representing the closure of three different coupler switches, illustrated as the four foot, eight foot and sixteen foot switches and representing the presence of three notes in the keyboard time slots representative of C, E and G. Of course, in different frames at different times, different patterns of the serial data of waveform K will exist in accordance with the actual notes being played on the organ and the condition of the coupler switches which are operated at various times.

Finally, waveform L of FIG. 2 illustrates the output of the data set strip line appearing on lead 27 from the output of the frame length and comparison circuit which shows the initial portion of this output as being "high" to cause the data stripper circuit 25 to blank out or fail to pass serial data during the time the serial data stream has the coupler switch information on it. This signal goes "low" at the time the keyboard information of the serial data stream is present, thereby causing the data stripper circuit 25 to pass the serial keyboard data unchanged for the remainder of each frame following this condition of operation.

As described above, the octave counter is reset at the strobe time of the multiplexer circuit 10 and is incremented with each roll-over of twelve counts of the note-name counter 16. An option for the operation of the octave counter, however, can be provided by way of a control of the type similar to the operation of the data stripper 25 by the frame length and comparator circuit 26 to hold the octave counter in its reset state for a preestablished number of consecutive octaves. This permits the system shown in FIGS. 1A and 1B to operate with the serial data from a pedel multiplexer scan or from a standard keyboard multiplexer scan produced by the manual keyboard scanner. In all other respects, the system operates the same irrespective of whether the notes produced by it are produced from a pedalboard of the organ or a manual keyboard.

As mentioned previously, the serial data produced by the multiplexer 10 includes the keyboard data and the control options data. The control options are in the first two octaves which are scanned, and this control options data is not used in tuning the top octave synthesizers; so that it must not be applied to the tuning logic. For this reason, the data stripper and latch circuit 25 is used, and the serial data is gated so that all of the information in the first octave and, as illustrated in waveform L of FIG. 2, the first two clock periods of the second octave are removed by the data stripper circuit 25. This option data is not used in the system of FIGS. 1A and 1B, but it is utilized in the multiplex system of the aforementioned patent and reference should be made to that patent for the manner in which the option shift register latch circuits are operated for storing and utilizing this data.

An additional digital function is required in the system besides the clock strobe and serial data function and that is the initialization of the system operation. The initializing circuit 20 is employed for two basic reasons. One is to reset all of the chip control logic and the second is to assign a sequence of numbers to several internal bookkeeping counters 45, one of which is associated with each one of the top octave synthesizer circuits 47 in the system. The bookkeeping counters 45 determine the order in which the different top octave synthesizer and coupler divider circuits 47 are assigned the tuning information.

Once the power supply of the system is activated and the first system strobe is obtained from the strobe circuit 15, a reset logic circuit 33 supplies a reset pulse to the initialize logic 20 to commence its operation. The reset time is under external control from other circuitry of the organ (not shown). Upon the release of the first reset pulse from the circuit 33, the initialize logic 20 generates an initialize "shift" output pulse on a shift output lead 34. This pulse is applied to the signal input of a one-bit shift register 46 associated with the first top octave synthesizer circuit 47 in the sequence of synthesizer circuits illustrated in FIG. 1B. This shift signal then is shifted with each 55 kHz clock pulse from the system clock 11 to the succeeding one-bit shift register stages 46 in a conventional manner. In addition, a second output of each of the one-bit shift registers 46 is connected to the "load" input of its corresponding bookkeeping counter 45 to cause the bookkeeping counter 45 to load into its counting stages a count equal to the count appearing on the parallel output leads from a master counter 50 (FIG. 1A).

The master counter 50 is reset to an initial count by the initializing logic 20 when the system is first placed into operation. This initial count is a count zero and it is stored in the first (the leftmost one) bookkeeping counter 45 when the first shift signal is shifted out of the first one-bit shift register 46 associated with that bookkeeping counter. As the clock pulses continue to be applied to the shift registers 46, the master counter 50 also is advanced one count for each clock pulse by gating such pulses through the initializing logic 20 to a lead 35 and through an increment control gating circuit 54 to the counter 50. The next bookkeeping counter in the sequence then is enabled at the second clock pulse to store the second count from the master counter 50, and so on until all of the bookkeeping counters 45 store numbers in ascending order determined by the outputs from the master counter 50. In this way, the first bookkeeping counter 45 (the leftmost one) stores a zero, the second stores a one, the third stores a three, and so on.

At this point in the system operation, all of the bookkeeping counters 45 have a number stored in them that dictates the order in which the related top octave synthesizer circuits 47 are assigned tuning information. Once the entire sequence of bookkeeping counters 45 have been filled with the counts providing this information, the initializing procedure for the bookkeeping counters is completed. This is all accomplished during the first two frames of the multiplex signal as counted by the first two stages of the time-out counter 21. At the end of this time, the enable signal from the counter 21 to the logic 20 terminates, disabling the gates of the logic 20.

The reset output from the logic circuit 33 also programs all of the seven-bit latch and comparator circuits 40 with a number which does not correspond to a valid note count, so that no two top octave synthesizer circuits 47 can subsequently be assigned with the same keyboard position. This could happen by chance, if more than one top octave synthesizer circuit 47 would initially power up with the same valid keyboard time slot number. Then if any two units were assigned the same keyboard time slot, the two units would play and be assigned new notes in unison, thereby effectively reducing the system capacity, so long as this condition existed.

The time-out counter 21 also comprises an additional part of the initializing logic. This counter operates to provide a reinitialization or a reactivation of the initializing logic 20 for resequencing the bookkeeping counters 45 anytime no keyboard serial data is entered into the system for a period of approximately five to ten seconds. This time period can be varied in accordance with the particular operating characteristics desired in the system. The actual time of the time-out counter 21 is dependent on the multiplexer frame length and the system clock rate of the clock circuit 11. This is necessary because a twelve stage counter clocked by the system strobe comprises the timing element of the time-out counter 21.

Control of the bookkeeping counters 45 after the initialization operation is provided by adaptive sustain logic in keyer pedestal logic circuits 49, one of which is provided for each of the different top octave synthesizer circuits 47. The keyer pedestal logic circuits 49 provide the attack, sustain and decay operation of the top octave synthesizer circuits 47 in accordance with the key closure and key release data in the serial data appearing on the lead 29, and as controlled by the output of the seven-bit latch and comparator circuit 40 associated with each individual keyer pedestal logic circuit 49.

As is explained more fully subsequentially, the keyer pedestal logic 29 functions to insure that all of the top octave synthesizer circuits 47 in the system must have been assigned a different keyboard position (a different root note) before any top octave synthesizer circuit 47 may be reassigned to a different note. When the system has been completely assigned, all of the top octave synthesizer circuits 47 are actively engaged in the production of a root note. However, it is possible (in fact more likely) that some top octave synthesizer system 47 in the system does not have a key closure (as determined by the keyer pedestal logic 49) currently associated with that note assignment. Such a top octave synthesizer is in its released or decay mode of operation, and if it has been in this mode longer than any other top octave synthesizer circuit 47 in a similar condition, it will be the next one to be reassigned a new note in the system.

An additional requirement which is controlled by the keyer pedestal logic circuits 49 and latch circuits 40 is that of causing a top octave synthesizer circuit 47 to rekey or be reassigned with a note if the key closure for that note is associated with the same note being produced or previously produced by that top octave synthesizer circuit. This occurs to cause such a top octave synthesizer circuit to rekey for the same note which it was previously producing even if that synthesizer circuit is out of the assignment sequence determined by the state of the count in the bookkeeping counters 45. As stated previously, except for this condition, the assignment sequence of the top octave synthesizer circuits 47 is controlled by the count in the bookkeeping counters associated with each of the different top octave synthesizer circuits 47.

Operation of the assignment logic to cause a particular top octave synthesizer circuit 47 to produce a note and the sustaining of that note under control the keyer pedestal logic 49 is described next. First, the seven-bit latch and comparator circuits 40, as mentioned previously, have parallel inputs applied to them from the note-name and octave counters 16 and 17 along with an input from a different latch load logic circuit 48 for each circuit 40. The seven-bit latch and comparator circuits 40 are operated by the output of the latch load logic circuits 48 to store the seven-bit note-name and octave number that is on the latch inputs whenever a load signal is generated by the latch load logic circuit 48 associated with any one of the latch and comparator circuits 40.

Assume initially that none of the top octave synthesizer circuits 47 are producing a note and that the system is in its start-up or initial state of operation. In this state, as described previously, the bookkeeping counters each have stored in them, following the initializing sequence, an increasing number obtained from the master counter 50 with the leftmost bookkeeping counter 45 of FIG. 1B storing a zero. An output of the bookkeeping counter 45 which has a zero stored in it is applied to its associated latch load logic circuit 48 to enable that latch load logic circuit for operation. The latch load logic circuits for the other top octave synthesizer circuits associated with bookkeeping counters 45 storing other numbers are not enabled by those bookkeeping counters. As a consequence, the first note in the first keyboard time slot which is on the serial data signal line 29 occurs in time coincidence with the outputs of the note-name and octave counters 16 and 17 which correspond to that note. This note is represented by the first pulse in the keyboard closure portion of the serial data signal train; and when it is applied to the latch load logic circuits 48, it causes the enabled latch load logic circuits 48 to produce a "load" signal pulse to the seven-bit latch and comparator circuit 40 associated with it to lock or latch that note into the comparator circuit 40. The output of the comparator circuit 40 in turn, is applied to the top octave synthesizer and coupler divider circuit 47 connected to it to cause the top octave synthesizer circuit 47 to produce the root note corresponding to this first pulse in the serial data signal train.

Each time an assignment takes place in the system, all of the bookkeeping counters 45 are decremented by one count as well as the master counter 50. This decrement pulse is produced by the keyer pedestal logic 49 which is triggered into operation by the pulse in the serial data signal coincident with an output from the latch and comparator circuit 40 storing the note data. This decrement pulse is applied over a lead 52 from the output of the keyer pedestal logic 49 to the inputs of a decrement control coincidence gating circuit 53 and an increment control gating circuit 54. The circuits 53 and 54 respond to signals of opposite polarity from the keyer pedestal logic circuits 49; so that when a keyer pedestal logic 48 produces an output representative of a key closure, the decrement control circuit 53 produces an output pulse on a lead 56 to decrease the count in the master counter 50 (this count previously was at its maximum following the initialize circuit function) and to decrease the count in all of the bookkeeping counters 45 in the system by one count represented by this single pulse on the lead 56. The counter 45 which already stored a zero count is unchanged; but all of the other bookkeeping counters are decremented by one count to cause the next bookkeeping counter to the right of the first bookkeeping counter 45 to then store the zero count, while the counter adjacent that counter on the right then is decremented from a count of two to one, and so on. As a result, the next top octave synthesizer latch load circuit 48 which is associated with the next bookkeeping counter 45 having a zero count is then enabled.

The initialization sequence causes the master counter 50 initially to store a number which is one bit higher than the highest number stored in any of the bookkeeping counters 45. Thus, when this decrement pulse appears over the lead 56 and is applied to the master counter 50, its count is decremented by one; but the count in the counter 50 is still one bit higher than the highest number in any of the bookkeeping counters 45.

When the keyer pedestal logic circuit 49 for the first top octave synthesizer circuit 47 assigned a note is operative to control the attack, sustain and decay of that note, a signal is applied from the output of the keyer pedestal logic 49 to the bookkeeping counter 45 associated with that top octave synthesizer circuit to prevent it from applying any further enabling signals to the latch load circuit 48 associated with that bookkeeping counter. As a consequence, the next pulse in the serial data stream applied to all of these latch load circuits 48 causes a load signal to be supplied by the latch load logic circuit 48 associated with the next bookkeeping counter set to zero. The seven-bit latch and comparator circuit 40 for that note generating unit of the system then is latched, as described previously, and the sequence is repeated for the next top octave synthesizer circuit 48 which is assigned the next note. This sequence of operation of decrementing the bookkeeping and master counters and enabling different ones of the note assignment units in sequence continues for the remaining pulses in the serial data stream signal on the lead 29.

Since the serial data stream is a cyclically repeating frame of serial data and since the keying of a note generally extends over many frames of this serial data, it is necessary to prevent data pulses in subsequent frames which are representative of key closures already assigned to top octave synthesizer circuits from being reassigned to different top octave synthesizer circuits. This is controlled by the comparator portion of the seven-bit latch and comparator circuit 40. The comparator circuits 40 are sampled in synchronism with the serial data stream by the clock pulses on the output of the system clock circuit 11. Any time the output of the four-bit note-name counter 16 and the three-bit octave counter 17 applied to the inputs of the comparator portion of the latch and comparator circuit 40 compare with or agree with the stored note and octave data previously latched into a comparator circuit 40, an inhibit pulse is applied from the output of the comparator circuit 40 in parallel to all of the latch load logic circuits 48 to prevent any of the latch load logic circuits 48 from passing a load signal to their respective latch and comparator circuits. As a result, once a note has been keyed and assigned to a particular top octave synthesizer circuit 47, it continues to be produced by that top octave synthesizer circuit 47 and the rekeying of that same note in a different top octave synthesizer circuit 47 is prevented.

If a keyed relating to an assigned top octave synthesizer circuit 47 is released, the keyer pedestal logic circuit 48 produces a signal to the corresponding bookkeeper counter 45 associated with such a top octave synthesizer circuit to cause the bookkeeping counter 45 to store the count presently appearing at that time in the master counter 50. At the same time, an opposite polarity pulse is applied over the lead 52 to the increment control logic 54 and the decrement control logic 53 to cause the increment control logic to produce an increment pulse to the master counter 50 to increase its count by one. Thus, the master control counter, once again, has a count which is one higher than any number in the bookkeeping counter sequence. As a consequence, the note which has just been released, as evidenced by the disappearance of the pulse representing the note from the serial data stream causes the bookkeeping counter 45 associated with the top octave synthesizer circuit 47 then producing the decay characteristics of that note to be the very last bookkeeping counter 45 to be reassigned, unless additional notes are subsequently released or that particular time slot representative of that note is rekeyed. If the note is rekeyed to cause the data pulse for that note to reappear in the serial data signal prior to the full decay of the note as controlled by the keyer pedestal logic 49 or prior to the reassignment of the synthesizer unit to a new note, the note is reassigned to the unit 47 which previously produced it. This rekeying is possible since during the time that the decay characteristics of the tone are present, the seven-bit latch and comparator circuit 40 which is controlling the production of that note continues to be latched to store that note characteristic. Thus, if the note should be rekeyed at any time prior to the reassignment of the top octave synthesizer previously producing this note, that same top octave synthesizer will be reassigned to the note irrespective of the count stored in the bookkeeping counter associated with it.

It would be noted that during the time the key which relates to a top octave synthesizer producing the note represented by that key is depressed (causing a pulse to continuously appear in the time slot assigned to that key in the serial data signal train) the output of the keyer pedestal logic 49 applied to the bookkeeping counter 45 associated with that top octave synthesizer circuit prevents the application of an enabling signal from the bookkeeping counter to its latch load logic circuit 48. Once the keyer pedestal logic 49, however, is caused to operate in its decay mode to control the top octave synthesizer circuit 48 connected to it, this inhibiting signal applied to the bookkeeping counter 45 is removed, so that the bookkeeping counter 45 is capable of producing an enabling signal to its associated latch load logic circuit 48 as soon as that bookkeeping counter 45 is decremented back to its zero count again, even though the associated top octave synthesizer circuit 47 may still be producing the previously keyed and released tone in its decaying portion of the attenuated output waveform.

If the organ keyboard was played in such a manner that a released note is subsequently rekeyed, as stated previously, the top octave synthesizer circuit 47 which previously was producing that note will again produce that note if the seven-bit latch and comparator circuit 40 associated with that top octave synthesizer has not subsequently been reassigned to a different note. This is effected by the simultaneous coincidence of the outputs from the seven-bit latch and comparator circuit to the keyer pedestal logic 49 for that top octave synthesizer, the timing pulse from the system clock, and the corresponding pulse in the serial data stream in that time slot applied to the keyer pedestal logic 49. Thus, the keyer pedestal logic 49 then is reactived to produce an output for controlling the attack, sustain and decay waveform at the output of the top octave synthesizer 47 connected to it, and the tone representing that note is once again produced by the top octave synthesizer 47 which previously produced it.

If the keyboard was played in such a manner that keys were depressed and released in a sequential manner without rekeying some notes before all of the top octave synthesizer units had been assigned, the simple logic which has been described would continue to work and no additional logic circuit would be necessary in the system to insure its correct operation. Because of the fact, however, that the bookkeeping counters 45 may end up out of sequence or without a zero being in any unit as a result of the rekeying of notes following their release, as described previously, an additional circuit control, indicated as a pack control circuit 60 (FIG. 1A) is necessary.

The pack control circuit is operated as a sequence in each frame of the serial data following the keyboard scan portion of the data stream. For example, as indicated in FIG. 2, the serial data stream typically comprises 145 pulses. As explained previously, the first two octaves of information includes the option and coupler control signals and these are stripped from the serial data stream by the data stripper and latch circuit 25. The keyboard time slots extend from the 24th clock pulse through the next 61 (for a typical keyboard) and the remaining clock pulses then are usable for additional functions. For the circuit shown in FIGS. 1A and 1B, these additional functions include the operation of the pack control sequence effected by the circuit 60. During this sequence, all of the bookkeeping counters 45 are "packed down" to an ascending order sequence, with the master counter 50 ending up storing a number which is one greater than the highest number stored in a bookkeeping counter 45.

The pack sequence control is initiated by an output from the octave counter 17 which occurs at the end of the last octave of the keyboard information. This signal is applied over a lead 62 to the data stripper and latch circuit 25 to inhibit the passage of any further serial data on the output lead 29 during the pack sequence. This means that the latch load logic circuits 48, the latch and comparator circuits 40, and the keyer pedestal logic circuits 49 are not affected by the pack sequence since their operation is controlled by pulses in the serial data stream produced on the lead 29 at the output of the data stripper and latch circuit 25. The signal on the lead 62 also is applied to the pack control circuit 60 to enable the pack control circuit for operation.

As described previously, pulses are applied to the increment control and decrement control logic circuits 54 and 53, respectively, whenever a key closure or a key release is indicated by an output from the keyer pedestal logic on the lead 52. These pulses are half-clock period wide pulses which are present from clock to clock in any period in which a keyboard time slot is loaded or released. If a key closure (represented by a pulse in an appropriate time slot of the serial data signal, waveform K of FIG. 2) is associated with a previously stored time slot, the inhibit signal applied from the output of the seven-bit latch and comparator circuit 40 associated with the latch load circuit 48 for that top octave synthesizer unit storing this data time slot causes an inhibit output to be applied to the lead 52 from the latch load circuit 48. This prevents a pulse representative of a key depression or loading of root note data into the system from being applied to the circuits 53 and 54. As a consequence, the decrement control circuit 53 is not operated for such a condition since in effect there has been no change in the status of operation of the top octave synthesizer tone generating units for such a condition.

It is apparent that without further control, the repetitive rekeying of the same note would soon cause the increment control circuit 54 to drive the count in the master counter 50 far above any reasonable count utilizable in the system. Similarly, the count stored in the bookkeeping counter 45 for the top octave synthesizer unit producing such a repetitively rekeyed note would soon have a count stored in it in excess of any count useful in the system. This is because the release of a note always produces an increment pulse on the lead 52 to increment the count of the master counter 50 by one count following the storage of the count in the counter 50, just previous to this increase, in the corresponding bookkeeper counter 45. To prevent the system from going beyond its limits, a limit control is obtained when the master counter 50 reaches the maximum count attainable in the system, and this limit signal is applied over a lead 63 to the increment control circuit 54 to inhibit its further operation. This same limit signal also is supplied to the pack control circuit 50 for purposes described subsequently in the operation of the pack sequence.

The outputs of the comparator circuits 40 which inhibit the operation of the latch load logic circuits 48 whenever there is a correspondence between data stored in any latch and comparator circuit 40 at the time a pulse representative of the same note appears in the serial data stream also are applied to the pack control circuit 60 as clock period wide pulses that occur each time the keyboard data for a stored note is scanned by the multiplexer system. This information is required to keep all of the assignment logic sections updated as to what notes are stored in the system and are being produced by the top octave synthesizer units 47. All of the bookkeeping counters 45 also have two other output signals which are labeled as the lines $\overline{O}$ and AZOB in FIGS. 1A and 1B. These lines are individually wired in parallel with all of the bookkeeping counters and are connected to the inputs of the pack control circuit 60.

Since it is highly likely that various previously assigned positions will be rekeyed in the playing of an organ utilizing this system, the bookkeeping counters 45 very well may reach a point where no zero count is present in any of them. This would mean that no different notes subsequently could be assigned to any top octave synthesizer 47 in the system. Similarly, as notes are rekeyed, no decrement pulses are produced by the decrement control circuit 53 as described previously, which prevents the master counter 50 from moving down one bit in response to the rekeying of such notes. As a result, the wrong number is stored in the master counter 50 and without the use of the pack control circuit 60, the system simply would cease to function. Because of this problem, a pack sequence at the end of each frame checks the system for out of sequence numbers in the bookkeeping counters 45 and packs them down into an ascending order sequence.

At the same time that this packing down of the bookkeeping counters 45 is occurring, the pack control circuit 60 tests for the maximum number of available top octave synthesizer circuits 47 in the system. Obviously, if all of the top octave synthesizer systems (typically twelve, but less could be used) were engaged in producing tones for depressed or operated keys of the organ, no new note assignments could or should take place. On the other hand, at any given time usually only some of the top octave synthesizer circuits 47 are producing tones for notes represented by depressed keys of the keyboard. Others of the top octave synthesizers may be producing tones for the decay portion of notes represented by released keys, whereas still others are completely off. The pack control sequence operates to determine the maximum number of available top octave synthesizer units in the system, and then a number one bit larger than this available number of top octave synthesizer units is entered into the counter 50. At the end of the keyboard scan if the system is already in the proper sequence, the packing down operation rolls the entire system through its sequence returning it back to the way it was before the pack control operation took place. In any event, after the pack sequence initiated by the pack control circuit 60 is completed, the system is ready for its next keyboard scan of the serial data applied to it by the data stripper and latch circuit 25.

The details of the pack sequence operation now will be discussed. Essentially the pack control circuit comprises a binary "twelve" counter for producing a count sequence equal to the number of bookkeeping counters in the system and a pair of logic gating circuits, shown as a redecrement circuit 65 and an adjustment control logic circuit 66. As described previously, the pack sequence is initiated by an enabling signal applied over the lead 62 to the pack control counter circuit 60. This enable signal resets the twelve counter in the pack control circuit to zero, inhibits the further passage of serial data by the data stripper and latch circuit 25, as described previously, and also resets the all zeros or busy (AZOB) latch in each of the bookkeeping counter 45 control sections.

If any of the bookkeeping counters are busy, the AZOB common output lead 68 connected in common to the all zero or busy latch circuit in each of the counters 45 is "high". If this lead has a "low " or nonactive signal on it, this indicates the whole system is not busy. In such an event, the redecrement logic circuit 65 is enabled to produce decrement pulses to the master counter 50 and the bookkeeping counters through the decrement control gating circuit 53, which functions in the manner described previously, to produce this decrement pulse on the lead 56 to these counters. The output pulses of the redecrement logic 65 also are applied to the pack control counter in the pack control circuit 60 to increment the twelve counter in the pack control circuit by one for each such pulse. This process continues under control of the clock pulse source in the redecrement circuit 65 until one of two things occurs.

If the system has no out of sequence numbers in the bookkeeping counters 45, each decrement pulse from the circuit 65 rolls one of the bookkeeping counters through zero back to its count of 11 (the maximum count in a system employing twelve top octave synthesizer units) and all of the remaining bookkeeping counters 45 have their counts decreased or counted down by one. Thus, as each zero comes up in the system, its associated latch (AZOB) is set. After eleven pulses from the redecrement circuit 65 occur, even a twelve note (12 TOS System) unassigned system will have had all of the bookkeeping counters 45 stepped through their zero count bringing the AZOB line 68 to its high state.

In the case of a twelve note unassigned system, one clock period after this change in the state of the signal on the lead 68 occurs, the master counter 50 is preset with a count of eleven. One more clock period will bring an end to the pack sequence because the twelve counter in the pack control circuit 60 is at count "twelve", producing an inhibit output signal on a lead 70 to terminate the operation of the redecrement circuit 65. This inhibit signal also is applied to the adjustment control logic 66 which is described subsequently. At this time also, all of the bookkeeping counters 45 have been rolled back or returned to their original number, and the system is ready to commence operation on the next frame of serial data from the multiplexer 10 in the manner described previously.

As notes are assigned in the system, the AZOB latches in the bookkeeping counters 45 associated with such notes are held set continually. That is, whenever a bookkeeping counter is associated with a top octave synthesizer 47 and keyer pedestal logic 49 actively engaged in producing a note, its busy latch (AZOB) indicates this and is held in set. This has the effect of taking such a bookkeeping counter and its synthesizer section out of the pack sequence since any bookkeeping counter 45 associated with an actively operating top octave synthesizer circuit 47 is not available for the assignment of new notes. Thus, the net size of the system is reduced so far as subsequent note assignments during the next frame is concerned.

If the system is out of sequence, that is, if as each output pulse from the redecrement logic 65 occurs, a new zero does not occur someplace in the system and the AZOB line 68 does not change state, a modified pack sequence occurs. In this case, all of the bookkeeping counters 45 that have not been at zero are decremented by an adjust pulse produced by the adjustment control logic circuit 66 until a zero is present as indicated by the $\overline{O}$ line. So long as no bookkeeping counter is at zero, this line enables the adjustment control circuit for operation and inhibits the redecrement circuit 65 from further operation. The adjustment control circuit 66 produces pulses at the system clock rate (circuits 65 and 66 both obtain clock pulses from the clock 11) which are applied to the bookkeeping counters to decrement all of those that have not been at zero by an adjust pulse until a zero is present as indicated on the $\overline{O}$ line. The adjust pulses are not applied to the counter in the pack control logic circuit 60, so that the twelve counter in the logic 60 is not changed in count during the operation of the adjustment control circuit 66. As soon as a zero is present in any bookkeeping counter 45, the signal on the $\overline{O}$ line changing to disable the adjustment control circuit 66 and to enable the redecrement circuit 65. The normal pack sequence under control of the redecrement logic gates 65 resumes after the adjustment is made.

The operation of the adjustment control logic 66 is applied to a "hold off" latch in the pack control circuit 60 to reset the latch one clock period later if it happened to be set. This prevents the master counter 50 from ignoring any further adjustment pulses. The $\overline{\text{STORED}}$ signal is used to inhibit the reset to the "hold off" latch if the note played was stored in the system. As long as no two bookkeeping counters 45 contain the same number, the system regains its equilibrium after a pack sequence. In a normally operating system it is not possible to load the same number in two or more bookkeeping counters 45.

The D.C. trigger (DC TRIG) is used to supply a control input through the pack control circuit 60 to the "preset" input of the counter 50. In the pack sequence if the "hold off" latch is set and no keys are down (inactive D.C. trigger), the counter 50 is preset to count 11 one clock period after AZOB lead 68 is active. In all other cases, the counter 50 is set to count 11 two clock periods after AZOB is active. If this were not done, a full size system that is inactive could end up with other than count 11 stored (if the counter 50 had an improper number).

As long as the organ with which the system of FIGS. 1A and 1B is associated continues to be played, the assignment of the top octave synthesizer circuits 47 and the operation of the pack functions controlled by the pack control counter 60 and the redecrement logic 65 and adjustment control logic 66, cyclically continues as described above. If the playing of the organ results in absence of the keyboard data in the serial data signal stream on the lead 13 for over ten seconds, the master counter 50 and the bookkeeping assignment counters 45 are reinitialized by the initialization logic 20. This inactivity is sensed by the time-out counter 21 which is supplied with the keyboard data pulses in the serial data signal stream on the output lead 29 from the data stripper and latch circuits 25. Each time a keyboard data pulse appears in the serial data signal stream, the time-out counter 21 is reset; so that during normal operation of the system, the initialize logic circuit 20 does not affect the system operation in any way following the initial start up sequence which has been described previously. By utilizing the time-out counter 21 to reinstitute the initial start-up signal conditions after ten seconds or more of inactivity, the system is provided with a back-up to realign the bookkeeping counter assignment logic if, by some remote chance, an improper sequence of numbers has been loaded or a bit of data has been lost over a period of time. Otherwise there is no necessity for utilizing the time-out counter 21, and it could be eliminated from the system.

The circuit of FIGS. 1A and 1B which has been described above functions well as a digitally controlled note assignment logic circuit for assigning and reassigning notes to the various top octave synthesizers used in the system on a priority basis. The use of the system permits a limited number of top octave synthesizer units to be employed in the organ and assigns new notes to the "occupied" top octave synthesizer which is farthest into its decay mode of operation following the release of the key which determined the note previously generated by the particular synthesizer. The results accomplished by this digital system, however, also can be achieved through the use of analog circuit techniques, and such an analog circuit for controlling the assignment and reassignment of top octave synthesizer circuits is shown in FIG. 3.

Figure 3:
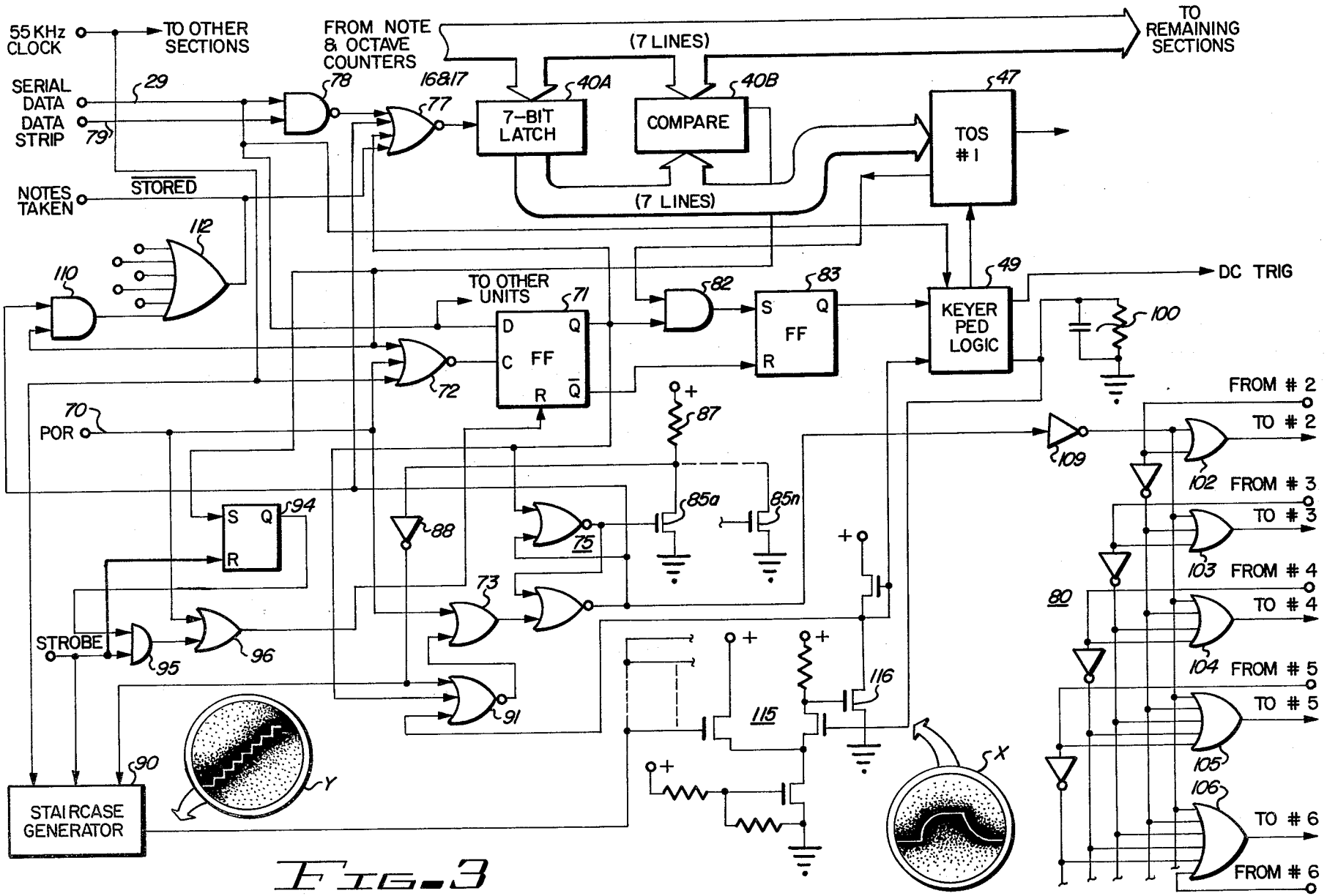
FIG. 3 is a block diagram of another preferred embodiment of the invention.

The circuit of FIG. 3 operates with the same multiplexer 10, system clock 11, note-name counter 16 and octave counter 17 shown in FIG. 1A. In FIG. 3, the circuit logic for controlling the assignment and reassignment of the total number of top octave synthesizers 47 in the system is illustrated, along with the logic unique to each one of the top octave synthesizers 47. It is to be noted that for each top octave synthesizer circuit 47 used in the system (typically there are twelve such synthesizer circuits), most of the logic of FIG. 3 is duplicated. This duplicated logic has not been shown in FIG. 3 since it would unnecessarily complicate the description of the system operation and it should be noted that the description of operation of the circuit of FIG. 3 associated with one of these top octave synthesizer circuits 47 applies equally as well to all of the other such circuits used in the system.

The parallel note and octave information generated by the note-name counter 16 and octave counter 17 is applied over the seven lines illustrated at the top of FIG. 3 to a seven-bit latch circuit 40A and a compare circuit 40B. These two circuits comprise the two functional portions of the circuit 40 which has been described previously in conjunction with FIG. 1B.

Assume initially that the system is in its start up mode of operation and that none of the top octave synthesizer circuits 47 in the system are assigned to any notes. When power is first applied to the system, a reset pulse (power on reset, POR) is applied over a lead 70 to reset a control flip-flop 71 to prepare the flip-flop 71 for the receipt of data to enable the top octave synthesizer for operation under control of the note assigned to that top octave synthesizer. After this initial reset pulse is applied over the lead 70, the potential of the lead 70 reverts to its opposite state to enable a NOR gate 72 for operation during the remainder of time the system functions. The reset pulse on the lead 70 also is passed by an OR gate 73 to a NOR gate "busy latch" circuit 75 comprising a pair of cross-coupled NOR gates, which function as a top octave synthesizer #1.

After this initial start-up condition of the system, a NOR gate 77 is enabled to pass pulses applied to it from the output of a NAND gate 78 to the seven-bit latch circuit 40A. The NAND gate 78 in turn is enabled by an output from the data strip circuit 25 (FIG. 1A) by an enabling input applied over a lead 79 to it when the data strip and latch circuit is enabled to pass the keyboard serial data after the stripping of the coupler and stop control data, as described previously.

Upon start up, a cascade OR gate logic circuit 80, also functions to inhibit or disable the latching circuits of all of the other top octave synthesizer circuits in the system, with the exception of the top octave synthesizer #1 (or the first in a predetermined order of synthesizer) which is the one illustrated in FIG. 3. The manner of operation of the circuit 80 is described subsequently in greater detail.

As described previously in conjunction with the description of operation with the circuit of FIGS. 1A and 1B, when the serial data representative of the keyboard time slot closures appears on the lead 29, the first pulse representative of a key closure passes through the NAND gate 78 and the enabled NOR gate 77 to the latch trigger input of the latch 40A to cause the latch 40A to store the octave and note data appearing on the inputs to it at the time of appearance of the serial data pulse. The information applied to the latch 40A is synchronized with the serial data and represents the decoded note and octave information for the note in the particular time slot occurring in synchronism with it. The output of the latch circuit 40A then is applied to the top octave synthesizer 47 (#1 of FIG. 3) to cause the generation of the selected root note.

When the latch circuit 40A is latched with the note to be produced by the top octave synthesizer circuit 47, the output of the latch circuit 40A also is compared with the note and octave data from the note and octave counters 16 and 17 (FIG. 1A) by a compare circuit 40B to produce an enabling pulse to a NOR gate 72, which then passes the next 55 kHz clock pulse applied to its third input to the clock input of the flip-flop 71. Since, at the same time, the serial data pulse which triggered off the latch signal to the latch circuit 40A is present on the "D" input of the flip-flop 71, it is set to cause its "Q" output to go high. This causes an AND gate 82 to pass a set pulse from TOS1 to a flip-flop 83, which in turn generates a keyer pedestal trigger pulse to the keyer pedestal logic 49. The flip-flop 83 remains set to this state until termination of the note sensed by the compare circuit 40B. As explained above, this termination is initiated by the disappearance of a pulse in the time slot corresponding to that note in the serial data appearing on the lead 29.

To indicate to the assignment system logic that a top octave synthesizer 47 (such as #1 of FIG. 3) is occupied or busy producing a note, the "Q" output of the flip-flop 71 also is applied to the busy latch circuit 75 to change its state to apply a signal to the gate of a normally conductive field effect transistor 85A to render the transistor 85A nonconductive. The transistor 85A is connected in parallel with similar transistors 85, all of which are controlled by the output of a different busy latch circuit 75 for each of the different ones of the other top octave synthesizer units used in the organ. Thus, so long as any one of the transistors 85 are conductive, the potential at the lower end of a common load resistor 87 is low or ground potential. Only when all of the transistors 85 are nonconductive does this potential rise to the near positive potential of the power supply connected to the upper end of the resistor 87.

The junction of the resistor 87 with the transistor 85 is coupled through an inverter 88 to an enabling input of a staircase generator 90 and to an enabling input of a NOR gate 91. So long as any one of the transistors 85 is conducting, the output of the inverter 88 is high, thereby inhibiting the operation of the staircase generator and inhibiting the NOR gate 91 from passing any pulses through to its output. This means that there still are available top octave synthesizers in the system and that any of these available top octave synthesizers can be assigned new notes.

As described above in the embodiment shown in FIGS. 1A and 1B, however, the system is designed to operate with a minimum number of top octave synthesizer circuits; so that it is possible for a new note to be keyed while all of the top octave synthesizers in the system are occupied or assigned to produce other notes in the system. If all of these other notes are the direct result of keys which are depressed at the time the new key is depressed, the new key simply is denied any access to any top octave synthesizer. As a consequence, the note represented by the depression of such a new key will not be sounded. As is generally the case, however, particularly is twelve (or even only six) top octave synthesizers are used to produce the root notes of the system, the keying of a thirteenth (or seventh) note generally takes place only when one or more of the other top octave synthesizers are operating in the decay mode of their operation representative of the terminal portion of a note sounded after the key previously assigned to that top octave synthesizer has been released.

As with the circuit of FIGS. 1A and 1B, it is desirable to assign the new note to the one top octave synthesizer circuit which is the farthest into its decay mode of operation, that is the one which has its output tone signal attenuated the most. To accomplish this purpose, another control flip-flop 94 is provided. This flip-flop is switched to its "set" state of operation each time a pulse is obtained from the comparison output of the comparator 40B. Thus, when a top octave synthesizer 47, such as TOS #1 shown in FIG. 3, is first engaged or assigned as described previously, this comparison output causes the "Q" output of the flip-flop 94 to go "high" to enable an AND gate 95. At the end of the frame of the serial data signal on the lead 29, the strobe pulse of waveform B of FIG. 2A is produced. One of these strobe pulses is applied to the other input of the AND gate 95 and passes through the AND gate 95 and an OR gate 96 to the reset input of the flip-flop 71. This causes the flip-flop 71 to be switched from its state where the "Q" output was high to the state where the "$\overline{Q}$" output goes high. This in turn causes the flip-flop 83 to be reset, removing the signal applied to the keyer pedestal logic 49. At the same time the strobe pulse also resets the flip-flop 94 to ready it for the next frame of operation.

The keyer pedestal 49 is constructed so that it does not sense any change in the keying information until two frames have gone by without a pulse in the keyboard time slot of the serial data signal which is assigned to the note which initially caused the flip-flop 83 to be set to its condition producing an output to the keyer pedestal logic. Therefore, the resetting of the flip-flop 83 does not have any affect on the circuit at this time. If, however, the note which is assigned to the top octave synthesizer 47 (TOS #1) no longer is keyed, the note data pulse is not present on the D input of the flip-flop 71 at the time the next compare pulse is obtained from the output of the comparator 40B. As a result, the flip-flop 71 is not reset to its condition with its "Q" output high and consequently the flip-flop 83 is not reset. This in turn then initiates the decay characteristics of operation of the keyer pedestal logic circuit 49, and the RC time constant circuit 100 connected to the keyer pedestal logic is effective to control the decay characteristics of the tone produced by the top octave synthesizer 47.

On the other hand, if a pulse is present at the keyboard time slot assigned to the note which is being produced by the top octave synthesizer 47, the flip-flop 71 is reset to its high "Q" state output causing the flip-flop 83 to be reset, and the keyer pedestal logic 49 continues to operate in its sustain mode of operation, with the foregoing cycle of the resetting of the flip-flops 71 and 83 taking place for each frame of operation of the serial data signal.

Even though the note which is being produced by the top octave synthesizer 47 (TOS #1) of FIG. 3 terminates in accordance with the above identified procedure, the seven-bit latch 40A is prevented from being reset or relatched to a different note because the NOR gate 77 continues to be inhibited from operation by the output of the busy latch circuit 75. This condition persists until all of the other top octave synthesizer circuits 47 in the system have been assigned. The OR gate assignment preferential circuit 80 comprises a cascade of busy latch disable OR gates 102 through 106 representative of the next five top octave synthesizer control units (TOS #2 through TOS #6) in the system of which the unit shown in FIG. 3 is a part. Additional top octave synthesizer control OR gates (not shown) can be used up to the maximum amount of top octave synthesizers 47 used in the system.

Normally the outputs of all of the OR gates 102 through 106 are "high", which in turn produces a high or disabling input to the corresponding NOR gate 77 connected to the respective outputs of the OR gates 102 through 106 in the succeeding series of top octave synthesizer control circuits used in the system. This means that all of the other NOR gates 77 are disabled until the top octave synthesizer unit of FIG. 3 is assigned and commences producing a tone representative of the first keyboard time slot having a data pulse in it representative of a depressed key on the organ.

When this first arrangement is made, the busy latch circuit 75 changes state, as described previously, causing a high enabling input to be applied to an AND gate 110 and a high disabling or inhibiting input to be applied to the NOR gate 77 in the top octave synthesizer circuit number one of FIG. 3. This high signal is inverted by an inverter 109 and is applied to the upper input of the first OR gate 102 in the preferential circuit 80, which causes the output of the OR gate 102 to go to a low output since it is supplied with a "low" signal on its other input from the output of the busy latch circuit 75 of the second top octave synthesizer unit (not shown) in the cascade. As a consequence, the output of the OR gate 102 applied to the NOR gate 77 associated with the second top octave synthesizer unit 47 (not shown) enables the NOR gate 77 of that second unit. That gate then responds to serial data pulses passed by its associated NAND gate 78 to control the latch circuit associated with the second TOS unit in the same manner described above in conjunction with the first unit shown in FIG. 3. From an examination of the preferential assignment circuit 80 of FIG. 3, it can be seen that each time the busy latch circuit 75 of the next succeeding top octave synthesizer circuit is switched to its "busy" condition, the next OR gate of the cascade of OR gates 102 through 106 in the series produces a low output, enabling the next succeeding NOR gate 77 in the system. This continues until all of the busy latch circuits 75 are latched to their "busy" operating conditions.

When all of the latch circuits 75 reach their busy condition, all of the parallel connected FET transistors 85A through 85N are rendered nonconductive. This then causes the staircase generator 90 to be enabled to commence its operation producing the staircase signal Y at its output, after it has been reset by the frame strobe pulse applied to it from the system strobe at each frame of the system operation.

At the same time, the NOR gate 91 in all of the top octave synthesizer sections in the system are enabled by the inverted output of the inverter 88 to respond to the output of a comparator circuit 115 applied through a source follower 116 for each of the top octave synthesizer units. There is a comparator 115, a source follower 116 and a NOR gate 91 in each of the top octave synthesizer circuits. A single staircase generator 90, however, is connected to the lefthand input of all of the comparators 115 as indicated in FIG. 3. Each of the different comparators 115 has its other input connected to the RC time delay circuit 100 associated with the keyer pedestal logic 49 of the top octave synthesizer circuit controlled by such keyer pedestal logic.

So long as the keyer pedestal logic 49 is in its sustain mode of operation, the potential applied to the right-hand side of the comparator 115 (indicated as waveform X) has a higher amplitude than the highest amplitude attained by the staircase waveform Y at the output of the staircase generator 90 during its cycle of operation. Thus, the staircase generator 90 has no affect on the operation of any circuit which is in its sustain mode of operation (representative of a depressed key in the organ).

For those circuits, however, which are in their decay mode of operation, indicating that the key has been released (and no pulse appears in the corresponding time slot of the serial data stream), the keyer pedestal logic is operating in its decay mode. The output waveform of such a keyer rapidly attenuates, as illustrated in waveform X.

Various cones of the different top octave synthesizer circuits in the system can be at different stages of their decay (attenuation) at any given time. This is indicated in waveform X by the generally exponential decay waveform shown on the right-hand end of the representation of the oscilloscopes trace of the attack, sustain, decay waveform characteristics of waveform X. This decaying or decreasing potential is applied to the comparator 115 at the same time the staircase increasing potential is applied to the other input. As soon as the staircase generator exceeds the voltage applied to the other input of one of the comparator circuits 115, that comparator circuit produces an output pulse through its associated NOR gate 91 to reset the busy latch circuit 75 with which it is associated to its "non-busy" condition. In this condition, the transistor 85 connected to the output of such a latch circuit 75 is rendered conductive. This terminates the operation of the staircase generator 90, which then is reset back to its initial zero condition of operation upon the occurrence of the next strobe pulse. The other top octave synthesizers which have decaying waveforms which are not as fully decayed (attenuated) as the one which caused the switching of the comparator circuit 115 described above, continue to decay in their normal manner until maximum attenuation (zero tone output) is reached.

When the latch circuit 75 for one of the top octave synthesizer circuits 47 has been reset as described above, the AND gate 110 associated with that latch circuit is disabled, and the NOR gate 77 is enabled to pass serial data pulses from the output of the NAND gate 78 to reassign or reset new note and octave information into the latch circuit 40A, thereby assigning a new note to the top octave synthesizer 47. The system then continues to operate as described above.

It should be noted that in order to prevent the accidental assignment of a note to more than one top octave synthesizer circuit 47, the AND gates 110 connected to different inputs of a common OR gate 112 are used to indicate each time a note is taken by the output obtained from the comparator circuits 40B in the system. The output of the OR gate 112 is connected in common to one input of all of the NOR gates 77 in the system and disables or inhibits those NOR gates from passing a pulse each time a pulse is obtained from the OR gate 112. Such pulses are obtained only when a note is already assigned to a top octave synthesizer 47, as indicated by the output of a comparator 40B, and this prevents the same note from being reassigned to a different top octave synthesizer 47 in the system.

It should be noted that under some conditions of operations, more than one note previously assigned to a top octave synthesizer may have fully decayed, as indicated by the waveforem "X", in a normal manner prior to the demand or reassignment for a new note in the system. In such an event, the operation of the staircase generator 90 and the comparator circuits 115, as described above, will result in the simultaneous resetting of those idle top octave synthesizer circuits. This, however, does not adversely affect the operation of the system in any way, since the preferential OR gate assignment circuit 80 prevents the simultaneous assignment of the next new note in the system to more than one top octave synthesizer in the manner described above. It is possible in a case where playing of the organ has terminated for a brief period of time that all of the top octave synthesizer busy latches 75 could be reset simultaneously, causing the system to revert to its original startup condition, the same as when the system initially has power applied to it to commence its operation.

The foregoing description of the analog version of the preferential assignment system shown in FIG. 3 shows that it is not necessary to utilize the pack control sequence bookkeeping circuits employed with the digital version, because of the manner of operation of the comparator circuits 115 and the preferential assignment OR gate circuit 80. Functionally, however, the analog system of FIG. 3 and the digital system described in conjunction with FIGS. 1A and 1B accomplish the same result. It is a matter of preference for the circuit designer as to whether the digital version or the analog version is employed in the system. It is possible to implement either the digital version or the analog version of the preferential assignment circuit as desired.

The foregoing descriptions made in conjunction with the drawings have been of two different preferred embodiments of the invention. Other variations of the circuits which have been shown in these two embodiments will occur to those skilled in the art without departing from the true scope of the invention as defined in the following claims.

We claim:

1. A method of providing a keyer control system for an electronic musical instrument including a plurality of tone generators each capable of producing tones, means for supplying input signals for said tone generators representative of different tones to be produced by said system, assignment circuit means coupled to said tone generators for enabling different tone generators to produce tones in response to said input signals, each tone generator producing a different tone according to the input signal applied thereto, and a keyer pedestal means coupled with each of said tone generators for controlling decay mode characteristics of the tone produced by the tone generator coupled therewith;

the method comprising the steps of forming a first count in a predetermined sequence of numbers having a total of different numbers at least equal to the number of tone generators in the system, assigning a different count of said predetermined sequence of said first count to a tone generator in one of the conditions of not producing a tone and producing a tone in a decay mode in order that each such tone generator is uniquely identifiable by virtue of the count assigned thereto, causing a tone generator not producing a tone to produce a tone in response to the next new input signal representative of a new note as determined by the counts assigned to the tone generators not producing tones taken in the predetermined sequence of numbers, and whenever all tone generators are in one of the conditions of producing a tone and producing a tone in a decay mode, causing the tone generator farthest into its decay mode of operation to produce a tone in response to the next new input signal representative of a new note as determined by the counts assigned to the tone generators in the decay mode taken in the predetermined sequence of numbers.

2. A keyer control system for an electronic musical instrument including a plurality of tone generators each capable of producing tones, means for supplying input signals for said tone generators representative of different tones to be produced by said system, assignment circuit means coupled to said tone generators for enabling different tone generators to produce tones in response to said input signals, each tone generator producing a different tone according to the input signal applied thereto, and a keyer pedestal means coupled with each of said tone generators for controlling decay mode characteristics of the tones produced by the tone generator coupled therewith;

said control system further comprising said assignment circuit means including a first counter means for counting in a predetermined sequence of numbers having a total of different numbers at least equal to the number of tone generators in the system, a second counter means associated with each of said tone generators, each of said second counter means being coupled to said first counter means and operative to count through said predetermined sequence of said numbers, and means for loading a different count of said predetermined sequence of said first counter means into each of said second counter means associated with a tone generator in one of the conditions of not producing a tone and producing a tone in a decay mode in order that each second counter means associated with such a tone generator is uniquely identifiable by virtue of the count loaded therein, said assignment circuit means also including means for causing a tone generator not producing a tone to produce a tone in response to the next new input signal representative of a new note as determined by the counts of said second counter means of the tone generators not producing tones taken in the predetermined sequence of numbers, and whenever all tone generators are in one of the conditions of producing a tone and producing a tone in a decay mode, said assignment circuit means causing the tone generator farthest into its decay mode of operation to produce a tone in response to the next new input signal representative of a new note as determined by the counts of said second counter means of the tone generators in the decay mode taken in the predetermined sequence of numbers.

3. The combination according to claim 2 wherein said first counter means is a digital counter means and each of said second counter means are digital counter means, said means for loading initially causing the storage of a different count in a sequentially ascending order in each of said second digital counter means, and means responsive to said input signal supplying means for changing the count in said first digital counter means to maintain a count in said first digital counter means and in one of said second digital counter means representative of the number of tone generators not producing tones, said assignment circuit means causing the count of said first digital counter means to be stored in the second digital counter means unique to a particular tone generator whenever such tone generator is released to operate in its decay mode, and thereafter said assignment circuit means changing the count in said first digital counter means accordingly.

4. The combination according to claim 3 and further including means operative at predetermined periodic intervals for re-establishing a predetermined relationship of the counts stored in said second digital counter means for insuring operation by said assignment circuit means in accordance with the sequentially ascending order.

5. The combination according to claim 4 wherein said means for supplying input signals comprises means for supplying binary encoded digital multiplex signals representative of said different tones to be produced by said system.

6. A method of providing a keyer control system for an electronic musical instrument including a plurality of tone generators each capable of producing tones, means for supplying input signals for said tone generators representative of different tones to be produced by said system, assignment circuit means coupled to said tone generators for enabling different tone generators to produce tones in response to said input signals, each tone generator producing a different tone according to the input signal applied thereto, and a keyer pedestal means coupled with each of said tone generators for controlling decay mode characteristics of the tone produced by the tone generator coupled therewith;

the method comprising the steps of:

providing a logic signal associated with each of said tone generators indicative of whether a respective tone generator is enabled to produce a tone, providing a predetermined signal when all of said tone generators are producing tones in response to one of an input signal and the decay mode characteristic, assigning a non-enabled tone generator in response to said logic signal and the absence of said predetermined signal to produce a tone in accordance with the input signal, providing a ramp signal responsive to said predetermined output signal, providing a unique signal representative of the decay characteristics of the tone controlled by each of said keyer pedestal means, comparing said ramp signal and each of said unique signals, determining by said comparison which of said tone generators in farthest into its decay mode of operation whenever the number of input signals for different tones to be produced by said system exceeds the number of tone generators, and causing the assignment of the tone generator farthest into its decay mode of operation to a new input signal representative of a new note.

7. A keyer control system for an electronic musical instrument including a plurality of tone generators each capable of producing tones, means for supplying input signals for said tone generators representative of different tones to be produced by said system, assignment circuit means coupled to said tone generators for enabling different tone generators to produce tones in response to said input signals, each tone generator producing a different tone according to the input signal applied thereto, and a keyer pedestal means coupled with each of said tone generators for controlling decay mode characteristics of the tone produced by the tone generator coupled therewith;

said assignment circuit means including logic circuit means coupled to each of said tone generators for providing a logic signal associated with each of said tone generators indicative of whether a respective tone generator is enabled to produce a tone and for providing a predetermined output signal when all of said tone generators have been enabled to produce tones, said assignment circuit means in response to the logic signal of the logic circuit means and the absence of the predetermined signal enabling a non-enabled tone generator to produce a tone in accordance with the input signal, a comparator means associated with each of said tone generators and having a first input and a second input, said comparator means being operative to compare the signals present at said first and said second inputs and provide an ouput signal representative of the comparison, a ramp generator responsive to said predetermined output signal of said logic circuit means which is rendered operative only when all of said tone generators are producing a tone, said ramp generator being operative to apply a ramp signal to the first inputs of all of said comparator means, and means operative during the decay mode for applying a unique signal representative of the decay characteristics of the tone produced by each of said keyer pedestal means to the second inputs of said comparator means for determining which of said tone generators is farthest into its decay mode of operation whenever the number of input signals for different tones to be produced by said system exceeds the number of tone generators for causing the assignment of the tone generator farthest into its decay mode of operation to a new input signal representative of a new note.

8. The combination according to claim 7 and further including busy circuit means coupled to said tone generators for providing a predetermined output signal when all of said tone generators have been assigned to produce tones by said assignment circuit means, and said busy circuit means further being coupled with said assignment circuit means for rendering said assignment circuit means operative whenever said predetermined output signal is produced by said busy circuit means.

* * * * *